US008182207B2

(12) United States Patent
Ballard, Jr. et al.

(10) Patent No.: US 8,182,207 B2
(45) Date of Patent: May 22, 2012

(54) INNER TURBINE SHELL SUPPORT CONFIGURATION AND METHODS

(75) Inventors: Henry G. Ballard, Jr., Easley, SC (US); Scott E. Ellis, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1101 days.

(21) Appl. No.: 12/049,665

(22) Filed: Mar. 17, 2008

(65) Prior Publication Data

US 2009/0232651 A1 Sep. 17, 2009

(51) Int. Cl.
*F01D 25/24* (2006.01)

(52) U.S. Cl. ..... 415/126; 415/134; 415/213.1; 415/214.1; 29/889.2

(58) Field of Classification Search ..... 415/126, 415/134, 135, 209.2, 209.3, 213.1, 214.1, 415/108, 136, 138; 29/451, 525.01, 525.03, 29/889.2, 889.22
See application file for complete search history.

(56) References Cited

U.S. PATENT DOCUMENTS 3,043,559 A * 7/1962 Bauer et al. ..... 415/138
3,498,727 A 3/1970 Martin, Jr. et al.
3,584,967 A 6/1971 Zerlauth
3,592,557 A 7/1971 Haas et al.
3,628,884 A 12/1971 Mierley, Sr.
3,740,168 A * 6/1973 Hug et al. ..... 417/360
3,754,833 A * 8/1973 Remberg ..... 415/108
3,937,589 A * 2/1976 Remberg ..... 415/101
4,112,582 A 9/1978 Beckershoff
4,286,921 A 9/1981 Donlan et al.
4,650,396 A 3/1987 Schwarz
4,890,978 A 1/1990 McLaurin et al.
5,141,394 A 8/1992 Donlan
5,921,749 A 7/1999 McLaurin et al.
6,082,963 A 7/2000 Sexton et al.
6,224,332 B1 * 5/2001 Leach et al. ..... 415/126
6,457,936 B1 * 10/2002 Leach et al. ..... 415/138

* cited by examiner

*Primary Examiner* — Edward Look
*Assistant Examiner* — Adam Benson
(74) *Attorney, Agent, or Firm* — Sutherland Asbill & Brennan LLP

(57) ABSTRACT

Embodiments of the present disclosure relate to a turbine which includes an outer shell, an inner shell connected to and surrounded by the outer shell in generally concentric relation therewith, at least one turbine rotor housed within the inner shell, a plurality of nozzles and shrouds carried by the inner shell, a plurality of connecting elements engaging between the inner and outer shells aligning the inner shell about the rotor, and at least one compliant support. Embodiments of the present disclosure also relates a method of configuring the securing arrangement between the inner shell and the outer shell of a turbine.

16 Claims, 9 Drawing Sheets

INNER TURBINE SHELL SUPPORT CONFIGURATION AND METHODS

TECHNICAL FIELD

The subject matter disclosed herein relates generally to turbines. More particularly, the present invention relates to a gas turbine configuration having an improved mounting arrangement between the inner and outer shells which enables thermal expansion and contraction of the inner shell relative to the outer shell in both the radial and circumferential directions.

BACKGROUND OF THE INVENTION

In prior U.S. Pat. No. 5,685,693 of common assignee herewith, there is illustrated an industrial gas turbine having inner and outer shells. The inner shell has a pair of axially spaced circumferential arrays of radially outwardly projecting pins terminating in reduced sections having flats on opposite circumferential sides thereof. Generally, cylindrical sleeves project inwardly and about access openings in the outer shell and have threaded bolt holes extending in circumferential directions. Bolts extend through the holes to engage the flats on the sides of the pins. By adjusting the bolts, the inner shell is adjustable externally of the outer shell to locate the inner shell about the rotor axis. During turbine operation, the inner shells may expand or move out of roundness and concentricity with respect to the outer shell when the shells respond to thermal and physical loads. Since turbine efficiency is affected by the roundness and concentricity of the inner shell with respect to the outer shell, this allowed realignment of the shells without disassembling the turbine. Roundness and concentricity determine the gap between the turbine buckets (attached to the rotor) and the bucket shrouds (attached to the turbine shell) which in turn determines the amount of gas that bypasses the bucket. Since no work is extracted from this bypass gas by the bucket, gas turbine performance is inversely proportional to this clearance gap.

This problem was further addressed in U.S. Pat. No. 6,457,936, which is hereby incorporated by reference in its entirety, with an improved mounting arrangement between the inner and outer shells using support pins loaded only in the circumferential or tangential direction. The circumferentially spaced support pins are disposed through access openings in the outer shell and have projections received in recesses of the inner shell to engage the two shells in a manner that supports the inner shell against radial and circumferential movement relative to the outer shell and enables thermal expansion and contraction of the inner shell relative to the outer shell in radial and axial directions. By controlling the thermal expansion and contraction of the inner turbine shell, the clearance gap between the bucket tips and the shrouds is controlled during the operation of the gas turbine, resulting in improved efficiency.

Recent simulations of the support pins, however, show that concentricity and roundness of the inner turbine shell are affected by how the pins initially are gapped during assembly. Specifically, for an inner turbine shell radially supported by multiple support pins, a minimum of at least two pins must support the gravitational loading when the rotor engine is at rest. When the engine starts, the support pins counteract the applied torque generated by the nozzles carried by the inner shell. The two gravitational loaded pins are exposed simultaneously to the gravitational and counteracting torque loadings, which leads to loss of roundness and concentricity when the shells differentially expand during turbine operation.

Moreover, one of the pins is exposed to a gravitational loading in the opposite direction as the counteracting torque loading. When the turbine runs, this pin and the next adjacent pin push the inner shell segment between them against each other. Consequently, when the segment of the inner shell expands during operation, this segment becomes pinched between the two pins, which causes the entire inner turbine shell to be eccentric and out of roundness. One way of addressing these problems is to relax the initial gaps of the support pins, but such configuration reduces turbine efficiency.

Simulations also show that the surface profile of the contact line between the pin and the inner shell affects the concentricity and roundness of the inner shell during turbine operation. Accordingly, there remains a need for a more advanced configuration arrangement between the inner and outer shells in advanced gas turbine design.

BRIEF DESCRIPTION OF THE INVENTION

To mitigate the gravity pin support dilemma, embodiments encompassed by the present disclosure provide a turbine comprising an outer shell, an inner shell connected to and surrounded by the outer shell in generally concentric relation therewith, at least one turbine rotor housed within the inner shell, a plurality of nozzles and shrouds carried by the inner shell, a plurality of connecting elements engaging the inner and outer shells and for aligning the inner shell about the rotor, and at least one compliant support. In a particular embodiment, the connecting elements have circumferentially facing arcuate sides engaging the inner shell along line contacts whose planer faces are directed radially to the rotor centerline.

Embodiments of the present disclosure also encompass a turbine comprising an outer structural shell, an inner shell connected to and surrounded by the outer structural shell in generally concentric relation therewith, wherein the inner shell has a plurality of recesses spaced circumferentially thereabout, a plurality of nozzles and shrouds carried by the inner shell, a turbine rotor housed within the inner shell, wherein the inner shell comprises two radial outward projections protruding in opposite directions along a horizontal split line of the rotor, a plurality of pins engaging between the inner and outer shells to align the inner shell about the rotor, wherein each pin engages each recess with a first circumferential clearance in the direction of the applied torque loading generated by the nozzles and a first circumferential clearance in the direction of the counteracting torque loading to enable differential growth and contraction of the inner shell relative to the outer shell, the outer shell further comprising two brackets to receive portions of the two radial outward projections to provide horizontal support for the inner shell during turbine assembly, wherein each radial outward projection engages each bracket with a second circumferential clearance in the direction of the applied torque loading generated by the nozzles and a second circumferential clearance in the direction of the counteracting torque loading to enable differential growth and contraction of the inner shell relative to the outer shell; and a spring affixed to one of the brackets to maintain the second circumferential clearance in the direction of the applied torque loading of that bracket at greater than about 0 mils.

Embodiments of the present disclosure also encompass a method for configuring a turbine with improved efficiency. The method includes providing an outer shell with at least two brackets, an inner shell with a plurality of recesses spaced circumferentially thereabout, the inner shell connected to and surrounded by the outer shell in generally concentric relation therewith by a plurality of connecting elements, a plurality of nozzles and shrouds carried by the inner shell, a turbine rotor housed within the inner shell, wherein each recess engages each connecting element to maintain a first circumferential clearance in the direction of the applied torque loading generated by the nozzles and a first circumferential clearance in the direction of the counteracting torque loading to enable differential growth and contraction of the inner shell relative to the outer shell in a circumferential direction of the rotor to enable differential growth and contraction of the inner shell relative to the outer shell, engaging the plurality of recesses with a plurality of pins, wherein each recess receives a portion of each pin with a first circumferential clearance in the direction of the applied torque loading generated by the nozzles and a first circumferential clearance in the direction of the counteracting torque loading, engaging two brackets of the outer shell with two radial outward projections of the inner shell protruding in opposite directions along a horizontal split line of the rotor during turbine assembly, wherein each bracket receives a portion of each radial outward projection with a second circumferential clearance in the direction of the applied torque loading generated by the nozzles and a second circumferential clearance in the direction of the counteracting torque loading, and affixing a compliant support to one of the brackets to maintain the second circumferential clearance in the direction of the applied torque loading of greater than about 0 mils.

Other objects, features, and advantages of this invention will be apparent from the following detailed description and claims.

DETAILED DESCRIPTION OF THE INVENTION

As summarized above, embodiments of the present invention encompass a turbine with an improved turbine efficiency and a configuration method for improving turbine efficiency by reducing the loss of roundness and concentricity of the inner shell with respect to the outer shell when the turbine is in operation.

In particular embodiments the turbine comprises an outer shell, an inner shell connected to and surrounded by the outer shell in generally concentric relation therewith, at least one turbine rotor housed within the inner shell, a plurality of nozzles and shrouds carried by the inner shell, a plurality of connecting elements engaging between the inner and outer shells aligning the inner shell about the rotor, and at least one compliant support.

Inner Turbine Shell Support Configurations

Figure 1:
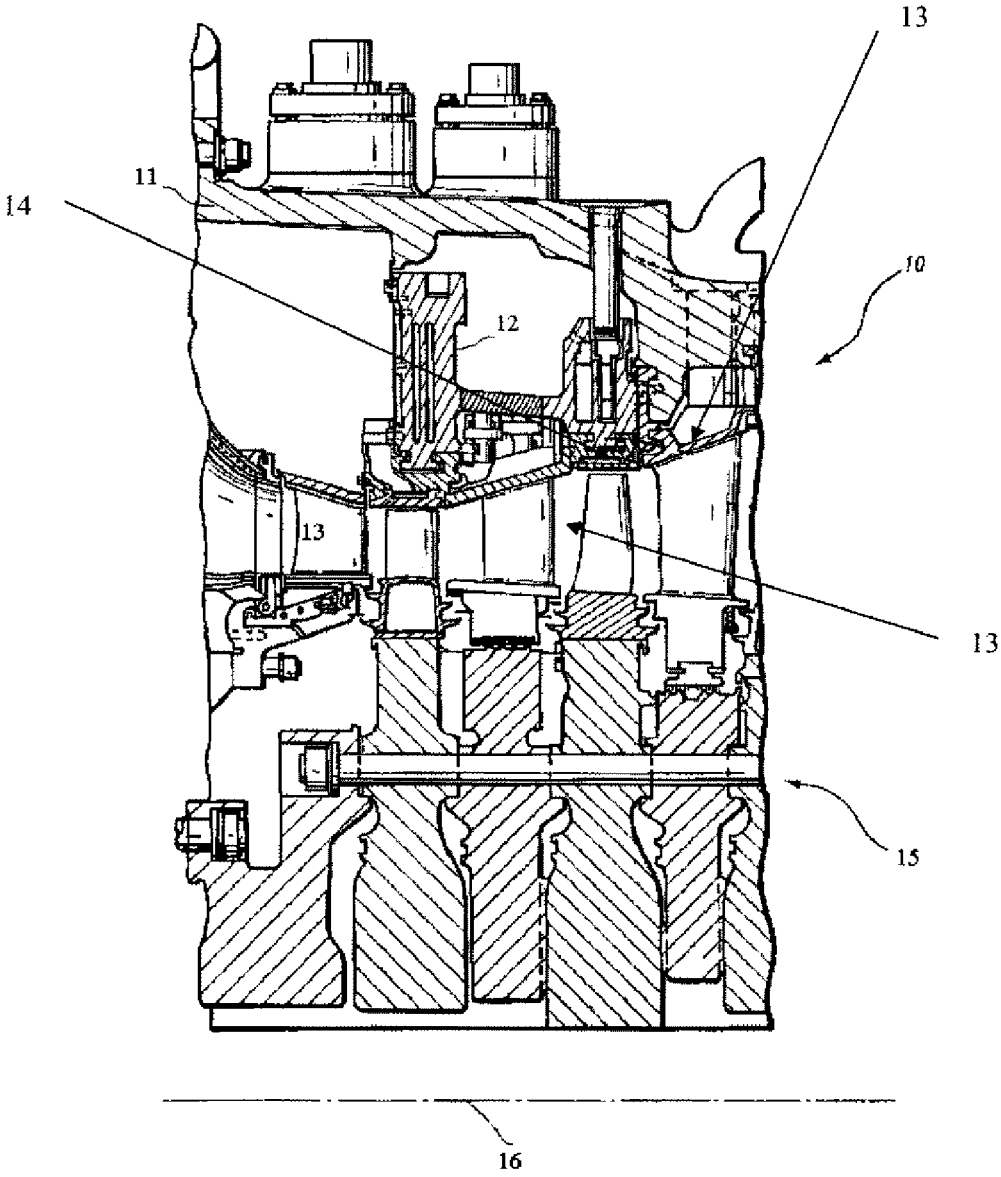
FIG. 1 is a fragmentary cross-sectional view of a portion of a section of a turbine incorporating a radial pin geometry.

A particular embodiment of a turbine section is illustrated in FIG. 1. The turbine 10 has an outer shell 11 and an inner shell 12 supported by the outer shell 11. The inner shell 12 carries an array of nozzles 13 and shrouds 14. The inner shell 12 surrounds a rotor, generally designated 15, rotatable about the rotor axis 16. A plurality of connecting elements secure the inner shell 12 to the outer shell 11 along radial planes normal to the axis of the rotor which are in the radial direction 110 and at axial locations in the axial direction 120 (not shown).

Figure 2:
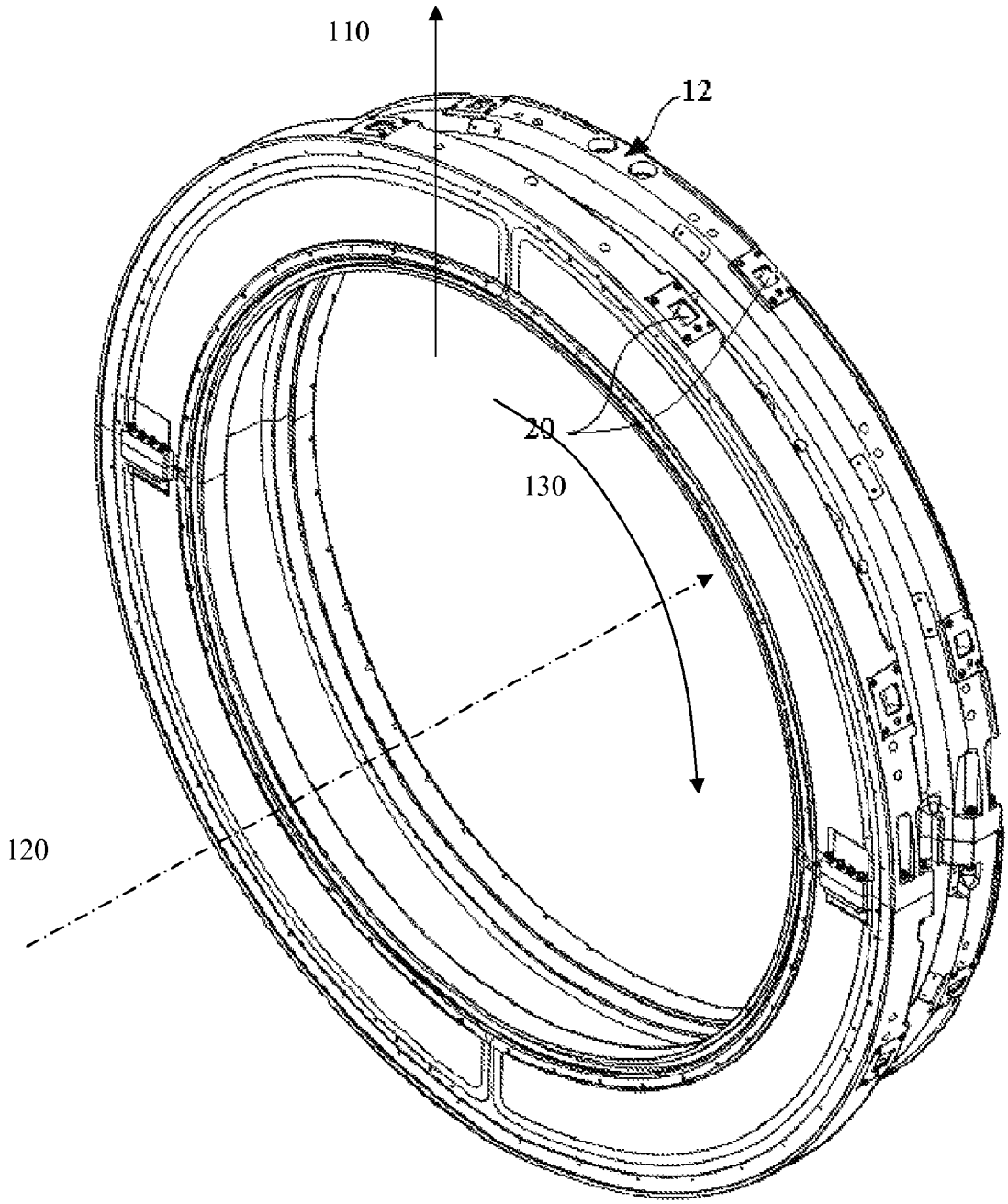
FIG. 2 is a perspective view of an inner shell with the nozzles not shown for clarity.

According to an embodiment illustrated in FIG. 2, the inner shell 12 comprises circumferentially spaced recesses 20 for receiving connecting elements. In a particular embodiment, illustrated in FIG. 3, the connecting elements comprise support pins 31 that pass through access openings 32 of the outer shell 11 and which are received by the recesses 20 of the inner shell 12. A plurality of circumferential clearances 33 and 34 in the circumferential direction 130 are provided between the support pins 31 and the recesses 20 of the inner shell 12. In particular embodiments, the turbine may further comprise a clearance in the axial direction 120 of the rotor within the recesses 20 of the inner shell 12 between the connecting element 31 and the inner turbine shell. Such axial clearances enable the differential growth of the inner shell relative to the outer shell 11.

Figure 4:
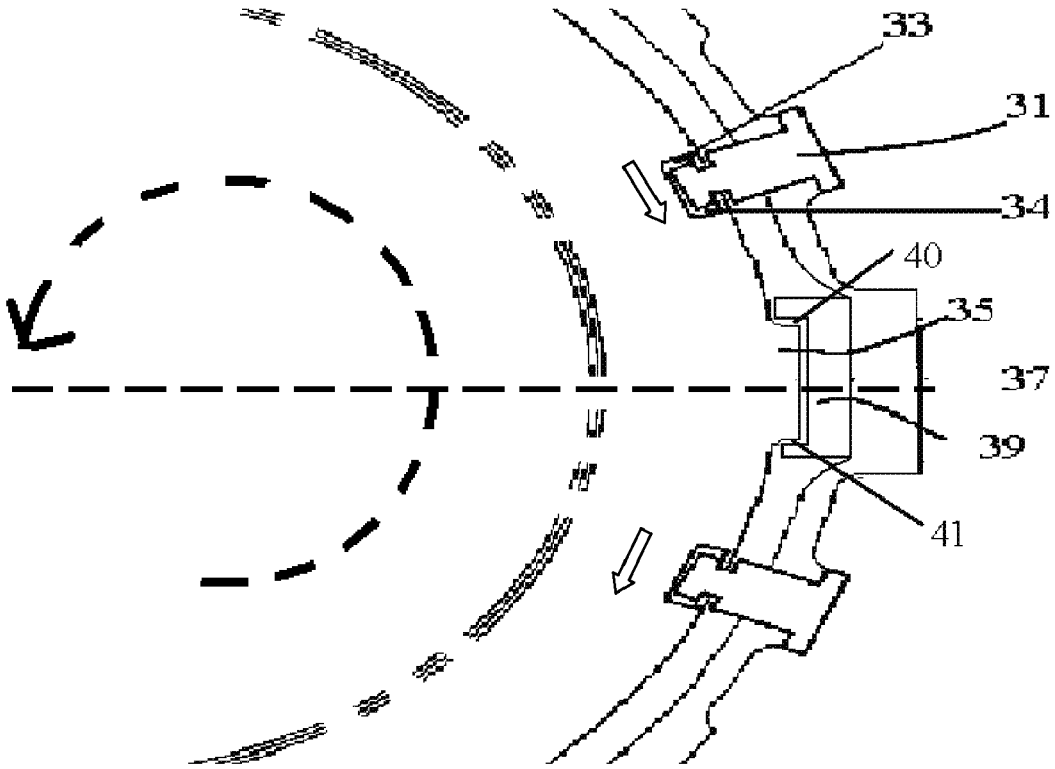
FIG. 4 is an enlarged view of the section A-A' of FIG. 3.

Those of ordinary skill in the art should appreciate that the turbine may comprise any suitable number of connecting elements. Theoretically, an infinite number of connecting elements would be most desirable; however, those skilled in the art will appreciate that an infinite number of connecting elements is impractical and that the maximum number of connecting elements therefore will depend on the manufacturing and cost considerations. For example, in particular embodiments the turbine comprise any number of connecting elements from two (2) to thirty six (36) more particularly from 4 to 16, and still more particularly from 6 to 10. For example, in a particular embodiment illustrated in FIG. 4, the connecting elements comprise eight support pins 31 spaced radially around the inner shell 12.

The inner shell 12 may further comprise at least two radial outward projections 35 and 36 protruding in opposite directions from the inner shell. In particular embodiments, the at least two radial outward projections 35 and 36 comprise pins 31 such as those described hereinabove. In a particular embodiment, the radial outward projections 35 and 36 are positioned along the horizontal split line 37 to provide horizontal support for the inner shell 12 during turbine assembly. The outer shell 11 may further comprise at least two support brackets 38 and 39 for receiving portions of the projections 35 and 36, respectively. In a particular embodiment, illustrated in FIG. 4, the brackets 38 and 39 engage the projections 35 and 36, thereby providing horizontal support for the inner shell 12 during turbine assembly, while also maintaining a desired circumferential clearance 40 and 41 between the projection 35 and 36 and the bracket 38 and 39.

Those of ordinary skill in the art will appreciate that when the turbine is turned on, the nozzles will generate an applied torque loading on the rotor as well as the inner and outer shells. Not wishing to be bound by any theory, it is believed that the support pins counteract the torque loading to reduce loss of roundness and concentricity of the inner shell with respect to the outer shell. For example, referring to FIG. 4, if the applied torque from the nozzles is counterclockwise (dashed arrow), the counteracting torque loading on the support pins would run clockwise (white block arrows). The circumferential clearances 33 and 40 are gaps "in the direction of the counteracting torque loading" because the clearances are narrowed when the counteracting torque loading pushes the inner shell against the pins. In one embodiment, the one or more circumferential clearances in the direction of the counteracting torque loading are configured to be between about 0 mils and about 20 mils during turbine assembly, between about 5 mils and about 15 mils, or between about 5 mils and 10 mils. In another embodiment, the one or more circumferential clearances in the direction of the counteracting torque loading are configured to be between about 0 mils and about 6 mils during assembly. In yet another embodiment, the one or more circumferential clearances in the direction of the counteracting torque loading are configured to be about 0 mils during assembly.

Using the same example in which the applied torque from the nozzles is counterclockwise, the circumferential clearances 34 and 41 are gaps "in the direction of the applied torque loading" because the clearances are narrowed when the applied torque loading pushes the inner shell against the pins. In one embodiment, the one or more circumferential clearances in the direction of the applied torque loading are configured to be between about 5 mils and about 20 mils during turbine assembly. In another embodiment, the one or more circumferential clearances in the direction of the applied torque loading are configured to be between about 8 mils and about 15 mils during assembly. In yet another particular embodiment, the one or more circumferential clearances in the direction of the applied torque loading are configured to be about 13 mils at assembly.

Generally, the sum of the circumferential clearances 33 and 34 or 40 and 41 (the total circumferential clearance) should be greater than the greatest thermal expansion of the connecting elements 31 and the recesses 20 to prevent these components from binding during engine operation. As such, the range for these circumferential clearances will depend on the size of the particular engine, the particular recess, and the particular connecting element which are being used.

Figure 3:
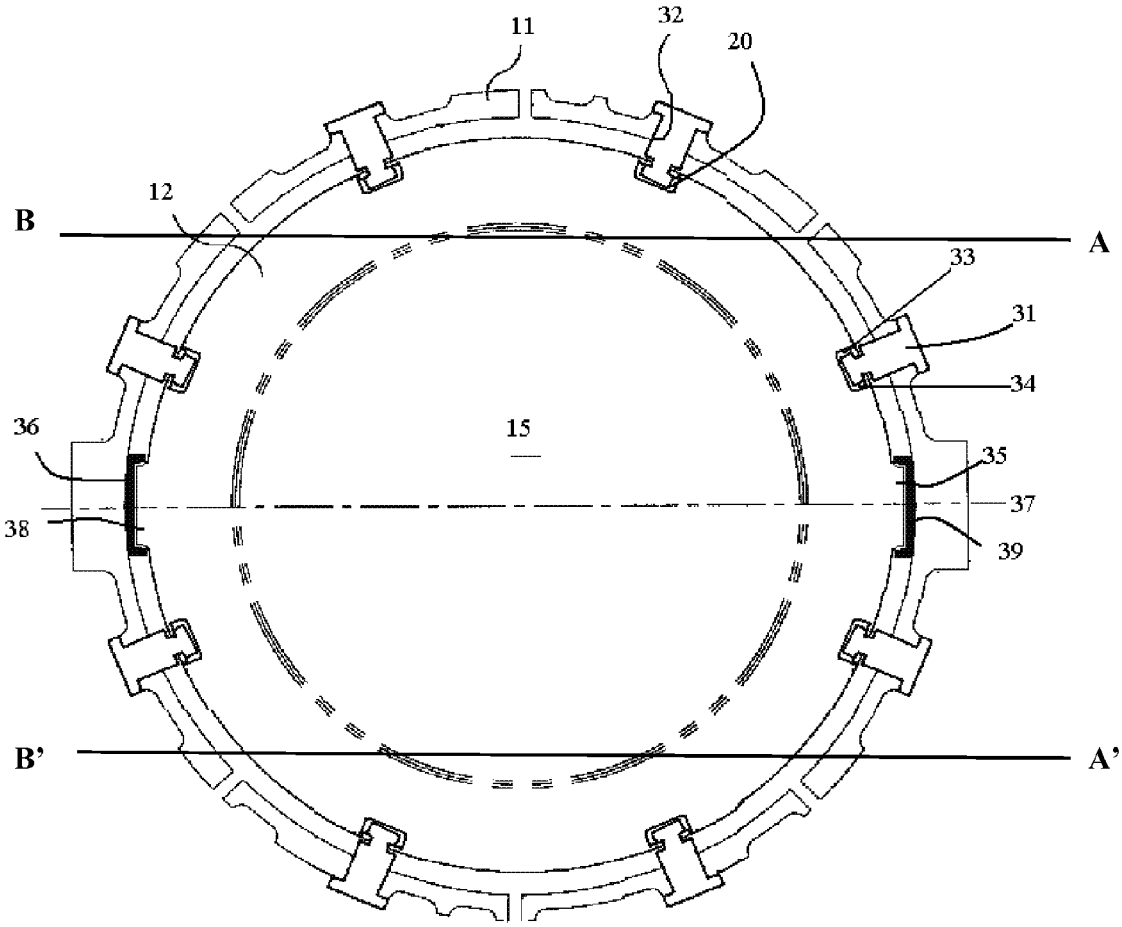
FIG. 3 is an axial schematic end view illustrating the connection between the inner and outer shells with pins engaging recesses and brackets engaging projections.

In the embodiments described above, the two radial outward projections 35 and 36 and their respective support brackets 38 and 39 are able to counteract the inertial load of the inner shell 12 during turbine assembly (FIG. 3). In order to ensure configuration of the circumferential clearances 40 and 41, embodiments of the present invention may further comprise a compliant support 51 disposed within the circumferential clearance 41 between the radial outward projection 35 and the support bracket 39 (FIG. 5A), such that it is exposed to both the inertial and counteracting torque loadings in opposite directions. Not wishing to be bound by any theory, it is believed that such a configuration counteracts the inertial load of the inner shell, enables the inner shell to thermally expand and contract in both radial and circumferential directions, and maintains concentricity about the rotor axis. This compliant support applies a sufficient force necessary to counteract the inertial forces during assembly, thereby closing the circumferential clearance 40 to nearly 0 mils. However, the force applied by the compliant support force should be insufficient to bind the outward projection 35 to the support bracket 39 due to the combined effect of the support force and the friction between the surfaces.

Figure 5A:
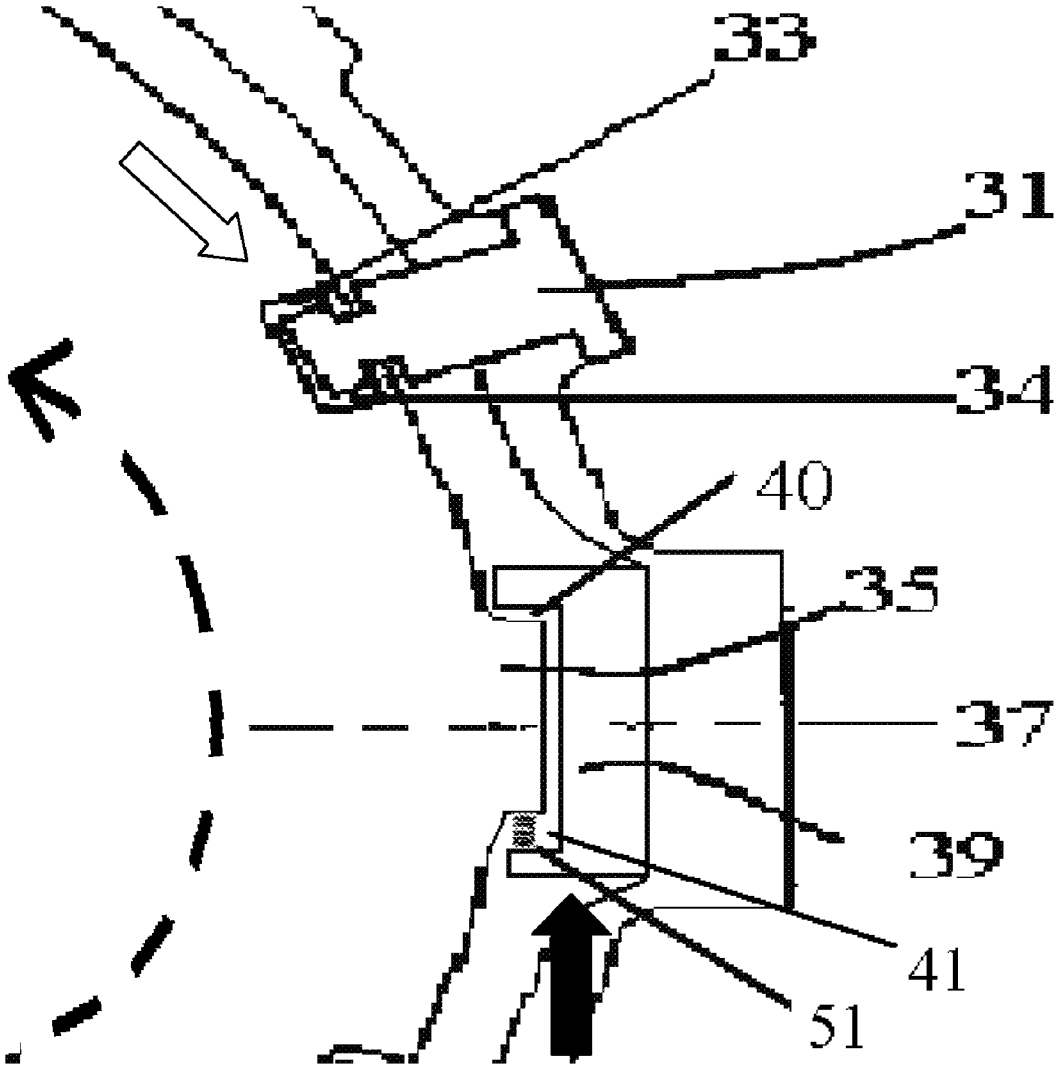
FIG. 5A is an enlarged view the section A-A' of FIG. 3 illustrating the forces on the connecting elements and the brackets in opposite direction.
Figure 5B:
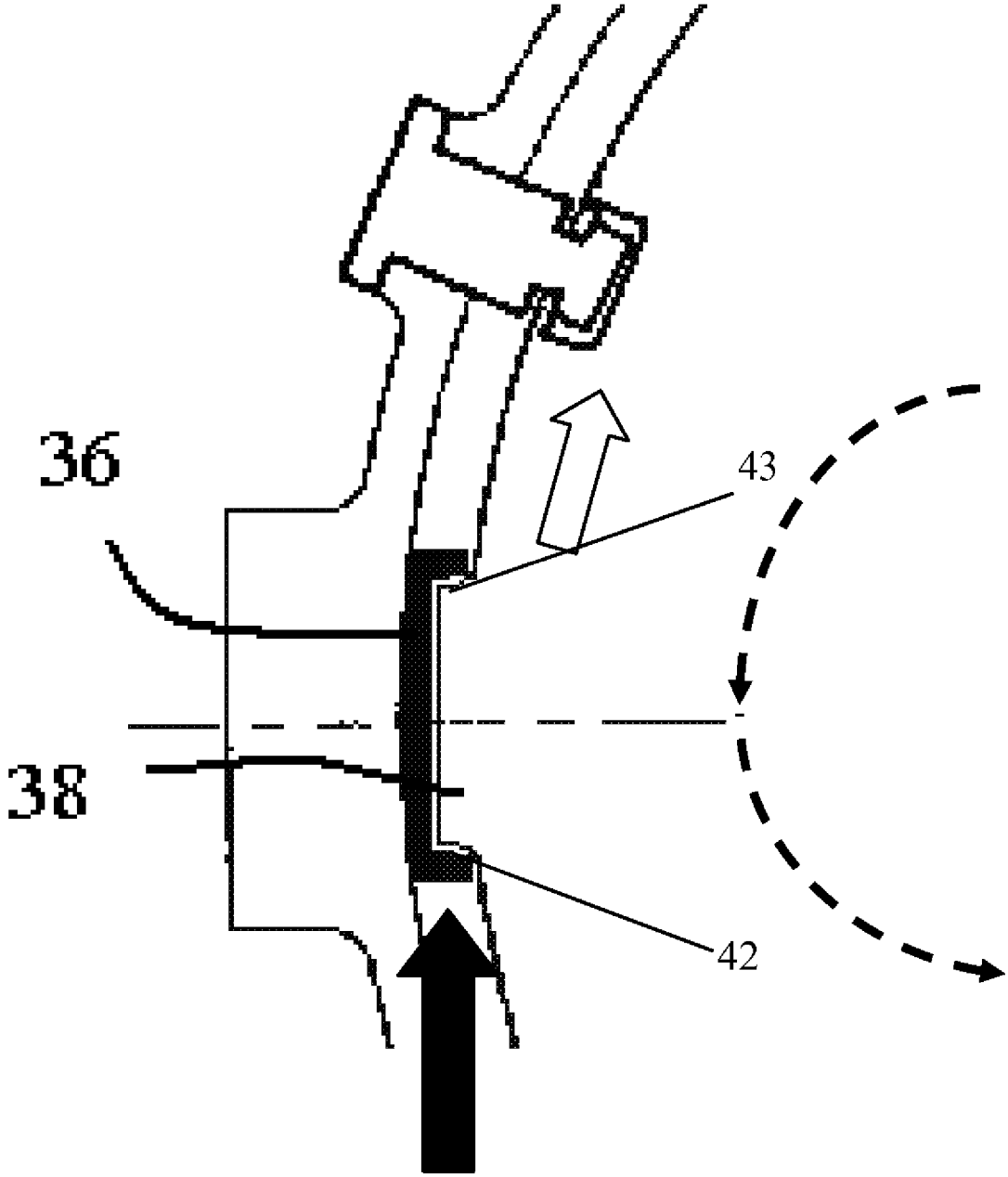
FIG. 5B is an enlarged view of the section B-B' of FIG. 3 illustrating the forces on the connecting elements and the brackets in the same direction.

For example, referring to FIG. 5A, the applied torque from the nozzles (dashed arrow) is counterclockwise and the counteracting torque loading on the pins (white block arrow) is clockwise. The inertial load on the bracket 39 is pushing upwards (black block arrow). In a particular embodiment, the compliant support 51 is affixed to the bracket 39 and exposed to gravitational and counteracting torque loadings in opposite directions, thereby maintaining the circumferential clearance 41 in the direction of the applied torque loading of that bracket at greater than about 0 mils during torque assembly and operation. The conditions of the opposite radial outward projection 36 and support bracket 38 with circumferential clearances 42 and 43 are illustrated in FIG. 5B. In this particular embodiment, the applied torque from the nozzles (dashed arrow) is counterclockwise, the counteracting torque loading on the pins (white block arrow) is clockwise, and the inertial load on the bracket 38 is pushing upwards (black block arrow). Because the inertial load and the counteracting torque loadings are coincident to each other, a compliant support is not required to maintain the circumferential clearances 42 and 43. In a particular embodiment, the circumferential clearance in the direction of the applied torque loading is maintained between about 0 mils and about 15 mils, or in another embodiment between about 5 mils and about 10 mils during turbine assembly and operation. In yet another particular embodiment, the circumferential clearance is maintained at about 13 mils during turbine assembly and operation. Those of ordinary skill in the art should appreciate, however, that suitable ranges for circumferential clearance generally are dependent upon the specific engine size being used.

Figure 6:
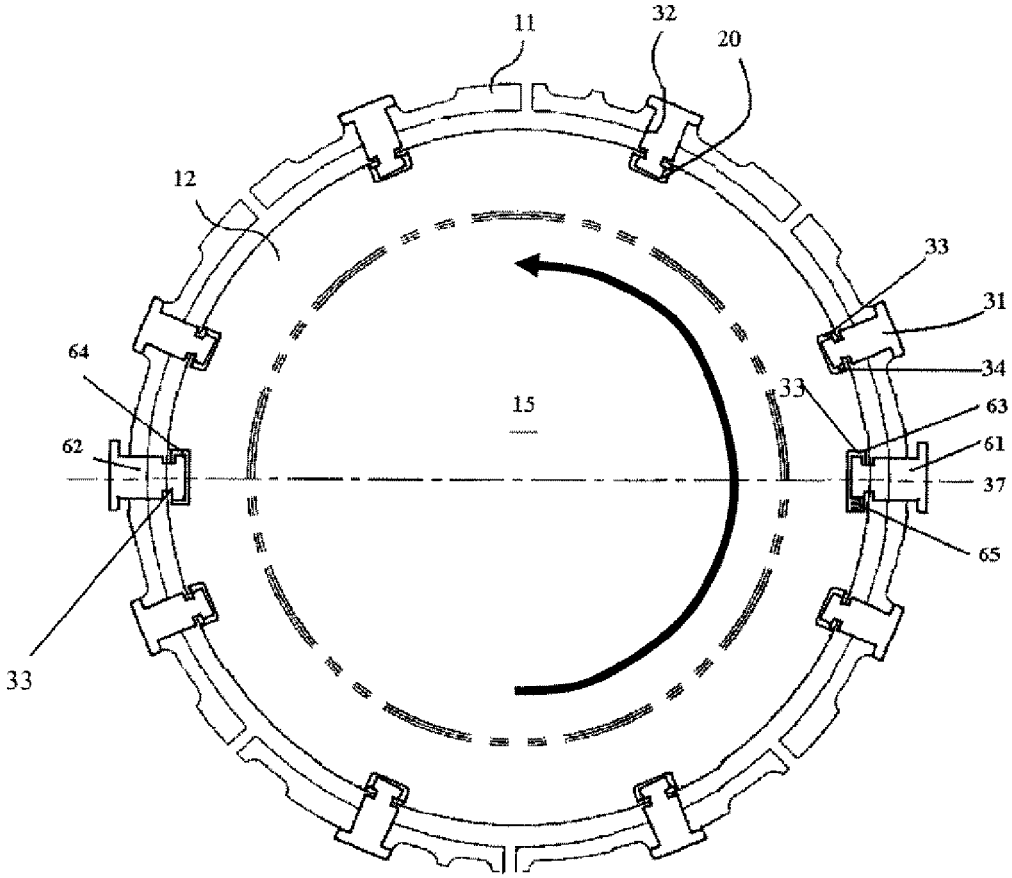
FIG. 6 is an axial schematic end view illustrating the connection between the inner and outer shells with only pins engaging recesses.

In an alternative embodiment, illustrated in FIG. 6, two additional pins 61 and 62 and corresponding recesses 63 and 64 are used in place of the projections 35 and 36 and the support brackets 38 and 39. The number and position of the pins and recesses may be adjusted so that they are spaced circumferentially thereabout the inner shell in any suitable manner. A compliant support 65 also may be added to the recess which is exposed to gravitational and counteracting torque loadings in opposite directions in order to maintain the circumferential clearances during turbine assembly and operation within the ranges described above. In this embodiment the circumferential clearances 33, in the direction of the counteracting torque loading, are closed during assembly (i.e., maintained at about 0 mils) and tend to remain closed during operation due to the counteracting nozzle torque effect while the circumferential clearances 34, in the direction of the applied torque loading, are greater than about 0 mils. In particular embodiments, the circumferential clearances 33 are closed during assembly and operation while the circumferential clearances 34 are between about 5 mils and about 15 mils.

In alternative embodiments, the connecting element which is exposed to the gravitational and counteracting torque loadings in opposite directions can be repositioned during turbine operation by an external mechanism.

According to particular embodiments, the compliant support comprises a spring, bellows, crest or wave spring, or any other suitable biasing device such as a force displacement device or constant force device (e.g. a pneumatic piston). Those of ordinary skill in the art should appreciate that the material for the compliant support will depend on the application of the turbine, and should take into consideration factors which include, but are not limited to, operating temperature, magnitude of the applied forces, and cyclic loading. Non-limiting examples of suitable materials for the complaint support include ferrous alloys, and non ferrous alloys, including stainless steel, phosphor bronze, and beryllium copper.

Connecting Elements Contact Surface Profiles

Figure 7:
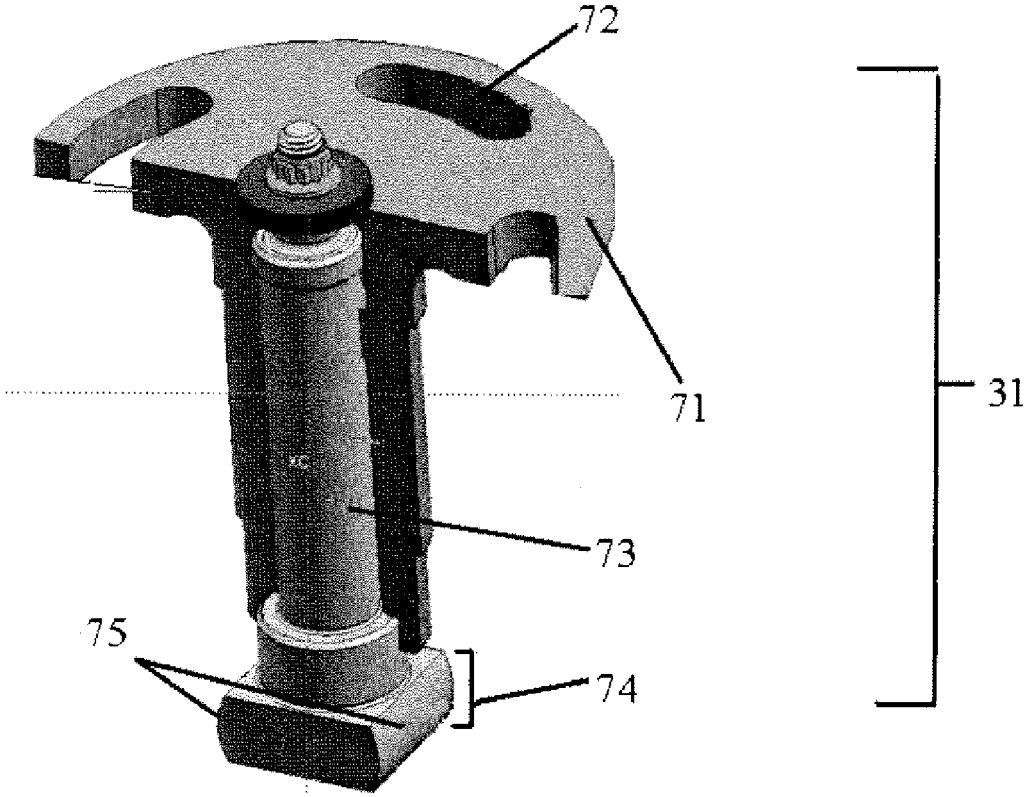
FIG. 7 is a fragmentary view of a support pin.

It also has been discovered that contact surface profile of the connecting elements with the inner shell affects the concentricity of the inner and outer turbine shells about the rotor axis. In particular embodiments, the support pins 31 illustrated in FIG. 7, comprise an enlarged head having a bolt circle 71 with a plurality of bolt openings 72, a generally cylindrical shank 73 and an expanded ledge 74 on the radial innermost end of the support pin. Each of the opposite circumferentially facing sides 75 of the ledge 74 has an arcuate surface. The arcuate surface of each side 75 comprises a portion of a cylindrical surface about an axis extending generally parallel to the axis of the rotor.

According to a particular embodiment, the arcuate surfaces of each side 75 of the support pins 31 bear in line contact along the sides of the recesses of the inner shell in the circumferential direction. The line contact extends in an axial direction. In a particular embodiment, illustrated in FIG. 8, the line contact 82 lies along surfaces whose planer faces which are directed radially to the rotor centerline (e.g., the arcuate surfaces of each side 75 of the support pins 31). When the support pins contact the inner shell 12 along surfaces whose planar faces are directed radially to the rotor centerline, with the outer 11 and inner shells 12 expanding or contracting at different rates, the resistance to this relative movement may be only the friction force due the contact force normal to the line contact and the coefficient of friction. If all such pin and inner shell configurations have the same configuration, the system would remain concentric.

Figures 8, 9:
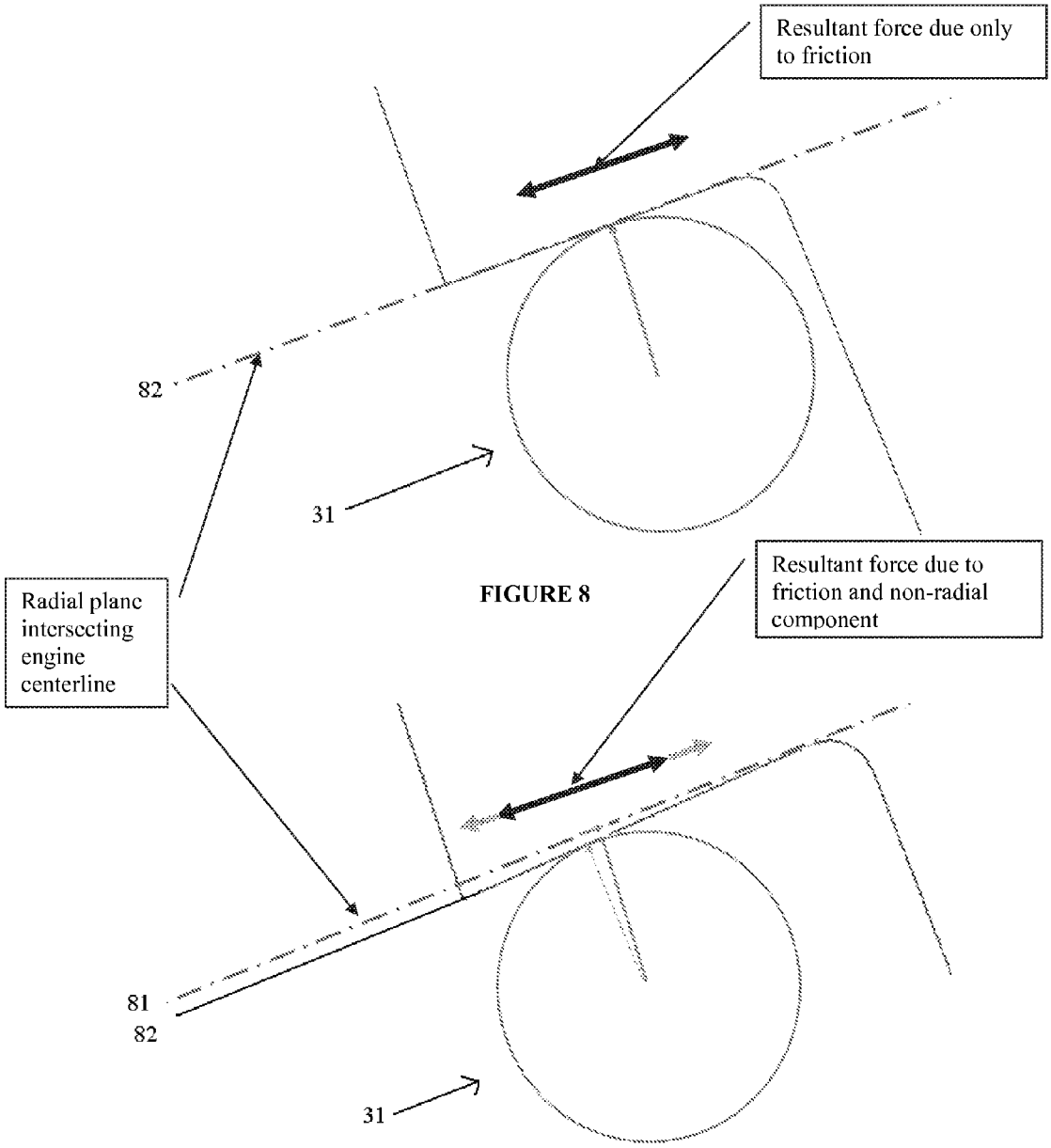
FIGS. 8 and 9 are top-down views of the contact between the pin and the inner shell recess.

As illustrated in FIG. 9, if the contact surface profile 82 is not coplanar with a line that is radially directed to the rotor center 81, radial force components may be created (in addition to friction) which may drive the ring to be eccentric as the ring expands or contracts thermally. As the inner shell expands or contracts, individual pin and shell contacts experience periods of no relative movement followed by sudden relative movement called stick-slip events. The non-radial force components adversely affect concentricity during these stick-slip events. In alternative embodiments, the connecting elements may have non-cylindrical contact surfaces that reduce or eliminate the radial force components described above; however, such connecting elements are beyond the scope of this disclosure.

It will be appreciated that the embodiments of the support pins provided herein enable the inner shell to thermally expand and contract in radial, circumferential and axial directions while maintaining roundness and concentricity about the rotor axis. When the turbine starts, the inner shell may be expanded radially outwardly relative to the outer shell by heating the inner shell. Similarly, upon the inner shell may be cooled to contract relative to the turbine rotor to control bucket to shroud clearances on demand. With the foregoing arrangements of the pins and their configuration, one pin or projection can simultaneously accept the torque loading and the gravitational loadings without pinching the segment of inner shell between the pins or projections. The pin surface contact profile also maintains concentricity of the inner shell relative to the outer shell and to the axis of the rotor. Further, because the recesses are larger in axial dimension than the axial dimension of the ledges and the ledges are located intermediate the recesses, differential growth of the inner shell in an axial direction is not taken up by the support pins.

The invention is further illustrated by the following example, which is not to be construed in any way as imposing limitations on the scope thereof. On the contrary, it is to be clearly understood that resort may be had to various other embodiments, modifications, and equivalents thereof which, after reading the description herein, may suggestion themselves to those skilled in the art without departing from the spirit of the present invention and/or scope of the appended claims.

A turbine comprising eight pins circumferentially spaced about the inner shell with two radial outward projections received by two brackets of the outer shell was first configured so that all clearances between pins and recesses and all clearances between brackets and projections were about 6.5 mils at assembly. After running an experiment measuring the temperatures and forces as a function of time, the resulting Fourier coefficients were extracted from the thermal/structural finite element analysis. The turbine was reconfigured so that the clearances in the direction of the counteracting torque loading were closed and the clearances in the direction of the applied torque loading were about 13 mils at assembly. The same experiment was run and the resulting Fourier coefficients were extracted. Comparison of the test results showed a 43 percent improvement of roundness in the second configuration when compared to the first configuration.

It should be understood that the foregoing relates to a particular embodiment of the present invention, and that numerous changes may be made therein without departing from the scope of the invention as defined from the following claims.

The invention claimed is:

1. A turbine comprising:

an outer shell;

an inner shell connected to and surrounded by the outer shell in generally concentric relation therewith;

at least one turbine rotor housed within the inner shell;

a plurality of nozzles and shrouds carried by the inner shell;

a plurality of connecting elements engaging the inner and outer shells and aligning the inner shell about the rotor, at least two of the connecting elements lying along a horizontal split line of the inner shell;

a plurality of recesses spaced circumferentially about the inner shell receiving portions of the connecting elements;

a first circumferential clearance between each recess and connecting element in the direction of the applied torque loading generated by the nozzles;

a second circumferential clearance between each recess and connecting element in the direction of the counteracting torque loading; and at least one compliant support disposed between at least one of the connecting elements and the recess being exposed to gravitational and counteracting torque loadings in opposite directions such that the sum of the first circumferential clearance and second first circumferential clearance is greater than about 0 mils.

2. The turbine of claim 1, further comprising:

at least two radial outward projections protruding in opposite directions from the inner shell along a horizontal split line of the inner shell, and at least two brackets on the outer shell along the horizontal split line of the inner shell for receiving the portions of the at least two radial outward projections from the inner shell.

3. The turbine of claim 2, further comprising a first circumferential clearance between each bracket and radial outward projection in the direction of the applied torque loading generated by the nozzles and a second circumferential clearance between each bracket and radial outward projection in the direction of the counteracting torque loading.

4. The turbine of claim 3, wherein the compliant support is disposed between the radial outward projection and bracket being exposed to gravitational and counteracting torque loadings in opposite directions such that the sum of the first circumferential clearance and second circumferential clearance is greater than about 0 mils.

5. The turbine of claim 4, wherein the first circumferential clearance is about 13 mils.

6. The turbine of claim 5, wherein the second circumferential clearance is about 0 mils.

7. The turbine of claim 1, wherein the first circumferential clearance is about 13 mils.

8. The turbine of claim 7, wherein the second circumferential clearance is about 0 mils.

9. The turbine of claim 1, wherein the compliant support comprises a spring, bellows, crest spring, wave spring, or biasing device.

10. The turbine of claim 9, wherein the spring is comprised of a material selected from the group consisting of ferrous and nonferrous alloys.

11. The turbine of claim 1, wherein the connecting elements have circumferentially facing arcuate sides for engaging the inner shell.

12. The turbine of claim 11, wherein the arcuate sides contact the inner shell along surfaces whose planer faces are directed radially to a centerline of the rotor.

13. A turbine comprising:

an outer structural shell;

an inner shell connected to and surrounded by the outer structural shell in generally concentric relation therewith, wherein the inner shell has a plurality of recesses spaced circumferentially thereabout;

a plurality of nozzles and shrouds carried by the inner shell;

at least one turbine rotor housed within the inner shell;

a plurality of pins engaging the inner and outer shells and aligning the inner shell about the rotor, wherein a portion of each pin engages each recess with a first circumferential clearance in the direction of the applied torque loading generated by the nozzles and a second circumferential clearance in the direction of the counteracting torque loading;

at least two radial outward projections protruding in opposite directions from the inner shell along a horizontal split line of the inner shell and at least two brackets on the outer shell along the horizontal split line of the inner shell for receiving the portions of the at least two radial outward projections from the inner shell, each radial outward projection and bracket having a third circumferential clearance in the direction of the applied torque loading generated by the nozzles and a fourth circumferential clearance in the direction of the counteracting torque loading; and at least one spring disposed between at least one of the radial outward projections and at least one of the brackets to maintain the third circumferential clearance at greater than about 0 mils.

14. A method of configuring a turbine comprising:

providing an outer shell with at least two brackets;

providing an inner shell with a plurality of recesses spaced circumferentially thereabout, the inner shell connected to and surrounded by the outer shell in generally concentric relation therewith by a plurality of connecting elements;

providing a plurality of nozzles and shrouds carried by the inner shell;

providing at least one turbine rotor housed within the inner shell;

engaging the plurality of recesses with a plurality of pins, wherein each recess receives a portion of each pin and comprises a first circumferential clearance in the direction of the applied torque loading generated by the nozzles and a second circumferential clearance in the direction of the counteracting torque loading;

engaging two brackets of the outer shell with two radial outward projections of the inner shell protruding in opposite directions along a horizontal splitline of the rotor during turbine assembly, wherein each bracket receives a portion of the radial outward projection and comprises a third circumferential clearance in the direction of the applied torque loading generated by the nozzles and a fourth circumferential clearance in the direction of the counteracting torque loading; and disposing a compliant support between at least one of the brackets and radial outward projections to maintain the third circumferential clearance at greater than about 0 mils.

15. The method of claim 14, wherein the compliant support comprises a spring, bellows, crest spring, wave spring, or biasing device.

16. The method of claim 14, wherein the connecting elements have circumferentially facing arcuate sides engaging the inner shell along line contacts whose planer faces are directed radially to a centerline of the rotor.

* * * * *